US011971231B2

(12) United States Patent
Kellgren

(10) Patent No.: US 11,971,231 B2
(45) Date of Patent: Apr. 30, 2024

(54) PISTOL

(71) Applicant: Kel-Tec CNC Industries Inc., Cocoa, FL (US)

(72) Inventor: George L. Kellgren, Cocoa, FL (US)

(73) Assignee: KEL-TEC CNC INDUSTRIES, INC., Cocoa, FL (US)

( * ) Notice: Subject to any disclaimer, the term of this patent is extended or adjusted under 35 U.S.C. 154(b) by 344 days.

(21) Appl. No.: 17/406,998

(22) Filed: Aug. 19, 2021

(65) Prior Publication Data

US 2023/0056193 A1 Feb. 23, 2023

(51) Int. Cl.

| | |
|---|---|
| ***F41A 17/30*** | (2006.01) |
| ***F41A 17/20*** | (2006.01) |
| ***F41A 17/34*** | (2006.01) |
| ***F41A 17/36*** | (2006.01) |

(52) U.S. Cl.

CPC ..... *F41A 17/30* (2013.01); *F41A 17/20* (2013.01); *F41A 17/34* (2013.01); *F41A 17/36* (2013.01)

(58) Field of Classification Search

CPC ..... F41A 17/20; F41A 17/22; F41A 17/24; F41A 17/26; F41A 17/28; F41A 17/30; F41A 17/32; F41A 17/34; F41A 17/36

See application file for complete search history.

(56) References Cited

U.S. PATENT DOCUMENTS 639,414 A * 12/1899 Luger ..... F41A 17/20 89/145
1,143,471 A * 6/1915 Whiting ..... F41A 17/36 89/137
1,416,671 A * 5/1922 Artamendi ..... F41A 17/26 89/137
1,719,384 A * 7/1929 Tansley ..... F41A 17/36 89/137
2,182,693 A * 12/1939 Harton ..... F41A 17/20 42/70.01

(Continued)

OTHER PUBLICATIONS

Sam Hoober, "Grip Safeties And Why They Aren't More Popular," Bigfoot Gun Belts, https://gunbelts.com/blog/grip-safeties/, Apr. 28, 2017, Accessed Jan. 21, 2021.

(Continued)

*Primary Examiner* — Gabriel J. Klein
(74) *Attorney, Agent, or Firm* — Bennet K. Langlotz; Langlotz Patent & Trademark Works, LLC

(57) ABSTRACT

Pistols have a frame, a firing facility operable to discharge the pistol, a safety device connected to the frame and having a safe condition in which discharge is disabled and an operable condition in which discharge is enabled, an actuator responsive to the presence of a safety-indicating element and operative to control the condition of the safety device such that the safety device is in the safe condition when the safety-indicating element is absent and in the operable condition when the safety-indicating element is present, a selector connected to the frame and operably connected to the safety device, and the selector being movable between an enabled position in which the safety device is operably responsive to the presence and absence of the safety-indicating element, and a disabled position in which the safety device remains in the operable condition irrespective of the presence and absence of the safety-indicating element.

16 Claims, 7 Drawing Sheets

(56) References Cited

U.S. PATENT DOCUMENTS

| | | | | | |
|---|---|---|---|---|---|
| 2,691,232 | A * | 10/1954 | Hoopes | F41A 17/26 | 42/70.08 |
| 3,857,325 | A * | 12/1974 | Thomas | F41A 17/20 | 89/190 |
| 4,800,665 | A * | 1/1989 | Schumaker | F41A 17/20 | 42/71.02 |
| 8,881,443 | B2 * | 11/2014 | Westwood | F41A 17/02 | 42/70.11 |
| 2002/0088159 | A1 * | 7/2002 | McMoore | F41A 17/20 | 42/70.08 |
| 2011/0107638 | A1 * | 5/2011 | Emde | F41A 17/36 | 42/6 |
| 2017/0299302 | A1 * | 10/2017 | Andrei | F41A 17/22 | |

OTHER PUBLICATIONS

Rick Hacker, "Magazine Disconnect," American Rifleman, https://www.americanrifleman.org/articles/2015/9/11/magazine-disconnect/, Sep. 11, 2015, Accessed Jan. 21, 2021.

* cited by examiner

PISTOL

FIELD OF THE INVENTION

The present invention relates to firearms, and more particularly to a pistol that has a compact size, a selector operable to control which of the pistol safeties are operational, and a slide assembly center of mass positioned to reduce muzzle whip.

BACKGROUND AND SUMMARY OF THE INVENTION

Pistols are popular for their ability to be carried in public in a concealed manner. Small caliber and small frame pistols that will fit in a pocket are especially popular for concealed carry. As a result, compact size is highly valued. It is also highly desirable to avoid accidental discharge of a concealed carry pistol, especially when the pistol is carried with a chambered round without the protective capabilities of a holster. Otherwise, the handgun could discharge if the user were to bump into something that could engage the trigger, such as a table corner, or if the trigger were inadvertently actuated when the user was retrieving the handgun from his or her pocket. A holster adds undesirable bulk and requires an additional removal step before the pistol can be operated. Additionally, small pocket carry handguns often have excessive muzzle whip that makes maintaining the sight picture difficult for a follow up shot.

Various types of pistol safeties are known, including grip safeties/disconnectors and magazine safeties/disconnectors. Grip safeties are frequently designed as a protrusion extending from the backstrap of the pistol frame that must be depressed by the user gripping the firearm in order to be disabled. The disadvantage of grip safeties is that inexperienced users, or users with small hands, can fail to grip the pistol correctly to disable the grip safety. Magazine safeties address a common safety issue with inexperienced users that a semi-automatic pistol must be safe without a magazine inserted. Instead, a live round could still be chambered, making the pistol capable of being discharged despite the absence of a magazine. Magazine safeties prevent a pistol from being fired unless the magazine is fully inserted. One disadvantage of magazine safeties is that the pistol will not fire if the magazine is not properly seated in the magazine well, which may be difficult for an inexperienced user in a stressful situation. Another disadvantage is the pistol is disabled during a tactical reload, which occurs when a partially empty magazine is replaced with a full magazine when additional rounds could be needed. The magazine safety prevents the user from discharging a chambered round until a magazine is inserted, which could create a dangerous situation.

Therefore, a need exists for a new and improved pistol that has a compact size, a selector operable to control which of the pistol safeties are operational, and a slide assembly center of mass positioned to reduce muzzle whip. In this regard, the various embodiments of the present invention substantially fulfill at least some of these needs. In this respect, the pistol according to the present invention substantially departs from the conventional concepts and designs of the prior art, and in doing so provides an apparatus primarily developed for the purpose of providing a pistol having a compact size, a selector operable to control which of the pistol safeties are operational, and a slide assembly center of mass positioned to reduce muzzle whip.

The present invention provides an improved pistol, and overcomes the above-mentioned disadvantages and drawbacks of the prior art. As such, the general purpose of the present invention, which will be described subsequently in greater detail, is to provide an improved pistol that has all the advantages of the prior art mentioned above.

To attain this, the preferred embodiment of the present invention essentially comprises a frame, a firing facility connected to the frame and operable to discharge the pistol, a safety device connected to the frame and having a safe condition in which discharge is disabled and an operable condition in which discharge is enabled, an actuator responsive to the presence of a safety-indicating element, and operably connected to the safety device to control the condition of the safety device such that the safety device is in the safe condition when the safety-indicating-element is absent and in the operable condition when the safety-indicating element is present, a selector connected to the frame and operably connected to the safety device, and the selector being movable between an enabled position in which the safety device is operably responsive to the presence and absence of the safety-indicating element, and a disabled position in which the safety device remains in the operable condition irrespective of the presence and absence of the safety-indicating element. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
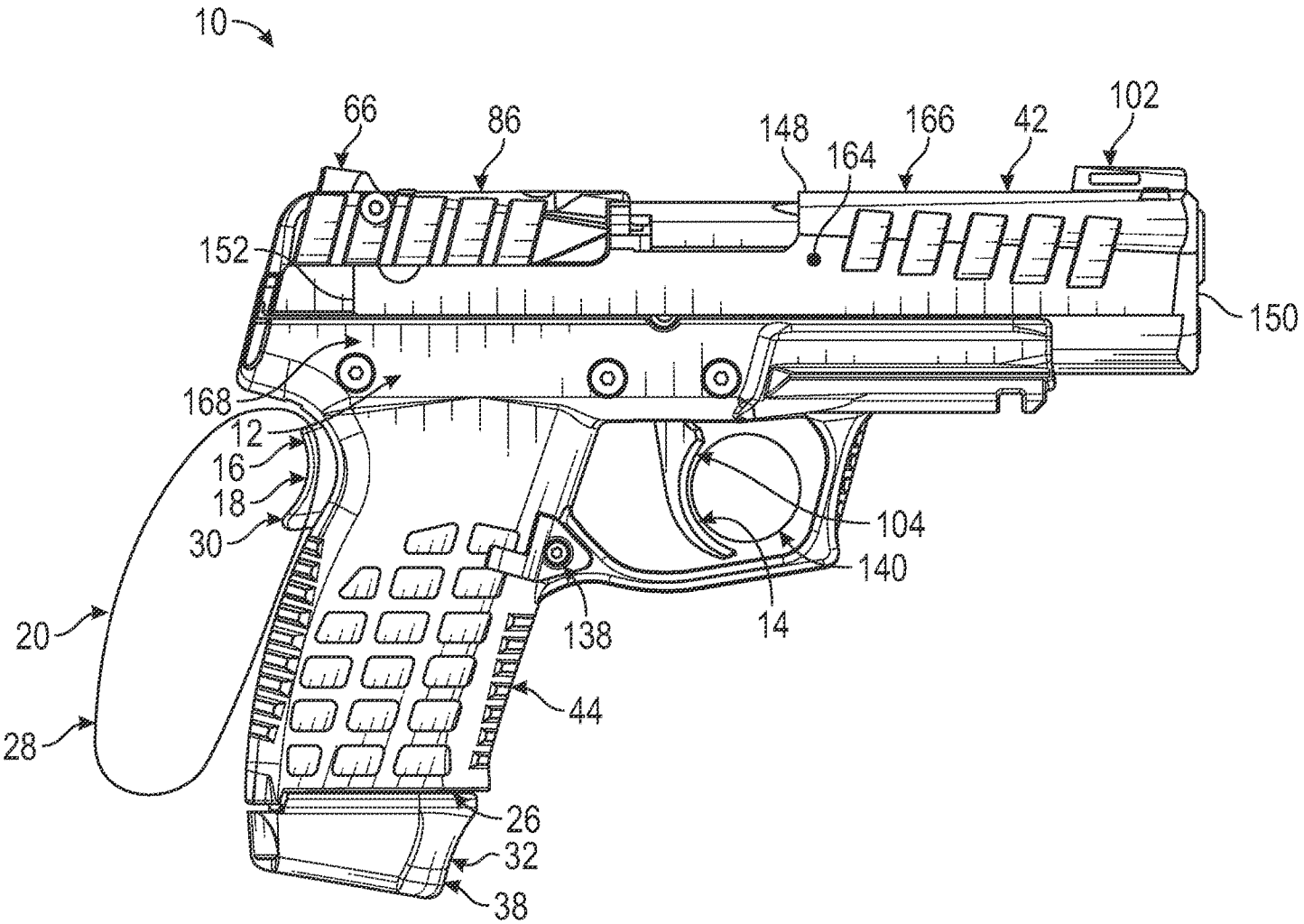
FIG. 1 is a right side view of the current embodiment of a pistol constructed in accordance with the principles of the present invention.

An embodiment of the pistol of the present invention is shown and generally designated by the reference numeral 10.

FIGS. 1-4 illustrate the improved pistol 10 of the present invention. More particularly, the pistol has a frame 12, firing facility 14, safety device 16, actuator 18, safety-indicating element 20, and selector 22. In the current embodiment, the firing facility is connected to the frame and operable to discharge the pistol. The safety device is connected to the frame and has a safe condition in which discharge of the pistol is disabled and an operable condition in which discharge of the pistol is enabled. The actuator is responsive to the presence of the safety-indicating element. The actuator is operably connected to the safety device to control the condition of the safety device such that the safety device is in the safe condition when the safety-indicating element is absent and in the operable condition when the safety-indicating element is present. The selector is rotatably received in the frame so as to be connected to the frame. The selector is also operably connected to the safety device. The selector is movable between an enabled position in which the safety device is operably responsive to the presence and absence of the safety-indicating element, and a disabled position in which the safety device remains in the operable condition irrespective of the presence and absence of the safety-indicating element. This is accomplished by the selector being an elongated shaft having a cam 24 operable to limit the position of the safety device.

The frame 12 defines a magazine well 26. The pistol also includes a removable slide 42 connected to the frame 12. The removable slide is operable to reciprocate on the frame. The selector 22 is enclosed and rendered inaccessible for movement except when the removable slide is removed from the frame. In the current embodiment, the safety-indicating element 20 can be a user's grip hand 28, and the actuator 18 can be a grip safety 30. The safety-indicating element can also be a magazine 32 when the magazine is properly seated within the magazine well, and the actuator can be a magazine safety 34. The pistol can include a second safety device 36 associated with a second actuator 38, in which case the selector 22 is movable between at least three positions. At least a first one of the selector positions operates to disable both safety devices, a second selector position operates to enable both safety devices, and a third selector position operates to enable only one of the safety devices. Alternatively, at least a first one of the selector positions operates to disable both safety devices, a second selector position operates to enable only a first one of the safety devices, and a third selector position operates to enable only a second one of the safety devices. As another alternative, at least a first one of the selector positions operates to enable both safety devices, a second selector position operates to enable only a first one of the safety devices, and a third selector position operates to enable only a second one of the safety devices. To accomplish this, the selector has at least two different cam profiles (24, 40), each associated with a respective one of the safety devices. The portion of each cam profile that interacts with each safety device when the selector is in a selected position determines if each safety device is enabled or disabled. It should be appreciated that if the selector is positioned to disable one or both safety devices, the selector immobilizes the actuator associated with the safety device(s) to be disabled in the operable position to enable discharge of the pistol. This means the grip safety is retracted as if squeezed by the user's grip hand, and the magazine safety actuator is elevated as if a magazine is present and properly seated in the magazine well.

The pistol 10 can also be viewed as having a grip safety 30 responsive to the presence of a user's hand 28 on the grip 44 in a conventional firing position with the user's forefinger 140 on the trigger 104, and operable to disable discharge of the pistol except when a user's hand is present, a magazine safety 34 responsive to the presence of a magazine 32 and operable to disable discharge of the pistol except when a magazine is present and properly seated within the pistol's magazine well 26, and a selector 22 operably connected to the grip safety and the magazine safety and having a plurality of positions, each corresponding to a different permutation of grip safety and magazine safety settings. In the current embodiment, the selector has at least three positions. One of the permutations includes enabling both safeties. One of the permutations includes disabling both safeties. One of the permutations includes enabling one, but not the other, of the safeties.

Figure 2:
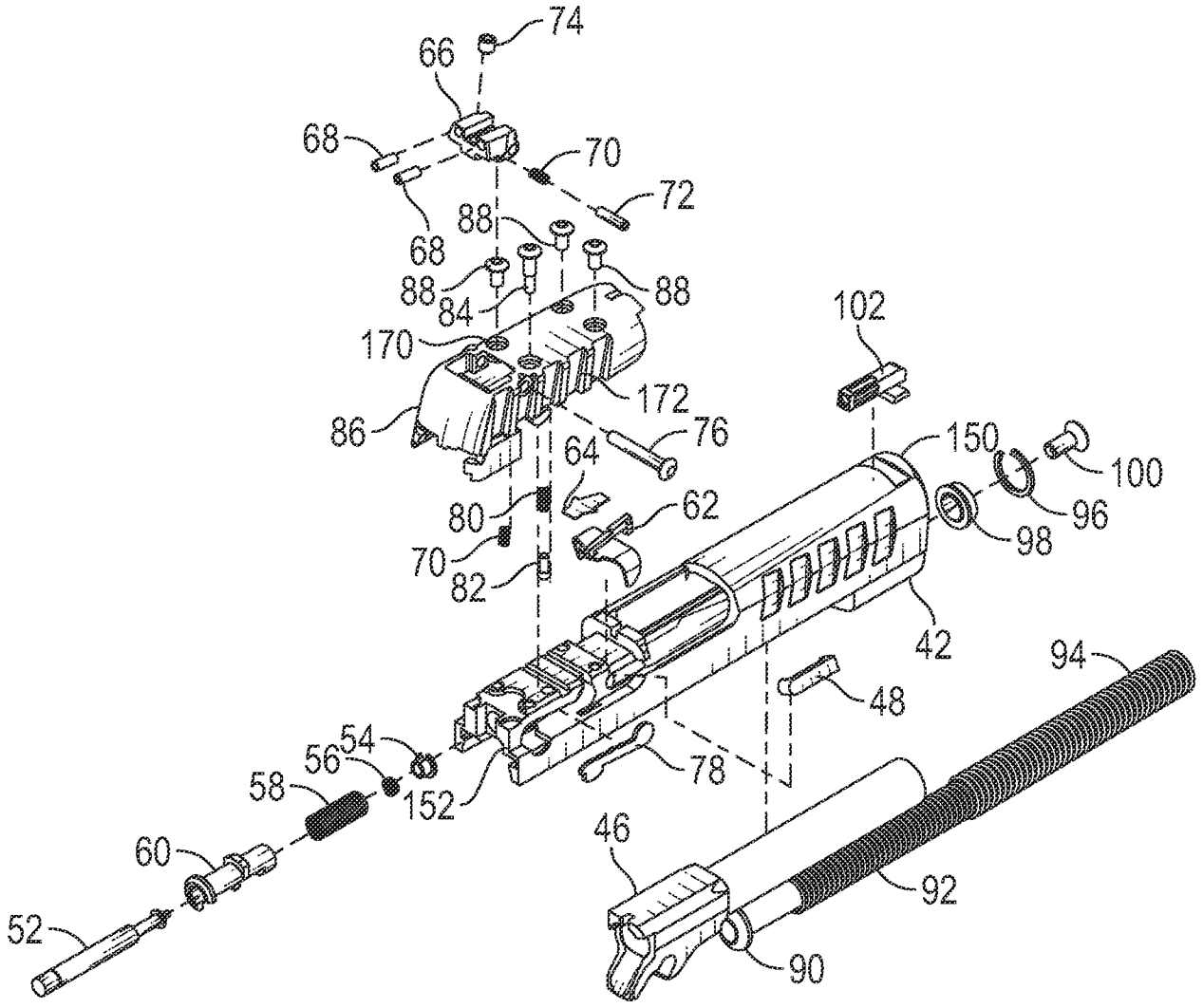
FIG. 2 is an exploded view of the slide assembly of FIG. 1.

Referring now to FIG. 2, the slide assembly 166 of the pistol 10 has a slide 42, barrel 46, extractor 48, extractor spring 50, striker 52, striker captor 54, striker return spring 56, striker spring 58, striker sleeve 60, chamber indicator 62, indicator spring 64, rear sight 66, sight fiber 68, rear sight springs 70, 3/3 2×⅜ dowel pin 72, M4×4 socket head screw 74, M3×20 button head screw, striker safety 78, striker safety spring 80, striker safety plunger 82, striker safety screw 84, slide cover 86, M3×6 button head screws, recoil spring guide 90, inner recoil spring 92, outer recoil spring 94, M12 retaining ring 96, spring bushing 98, M4× flathead screw 100, and hiviz tritium sight 102. The slide has a top 148, from 150, and rear 152. The slide cover is a molded plastic part that is bolted down to the top rear of the slide. The slide cover restrains the striker sleeve. The slide cover has serrated sides 170, 172 so the user can grip the slide cover easily with the user's forefinger 140 and user's middle finger 162 to pull the slide assembly 166 rearward to chamber a round. The slide assembly has a center of mass 164, which is forward of the center of mass associated with a conventional slide assembly to reduce to reduce muzzle flip from recoil force. This is accomplished because the slide cover replaces a conventional metal rear exterior portion of the slide, which is much heavier than the molded plastic slide cover. However, it should be appreciated that the slide is sufficiently long enough to have forward and rear rails to engage the frame. The front sight is attached to the top front of the slide.

Figure 3:
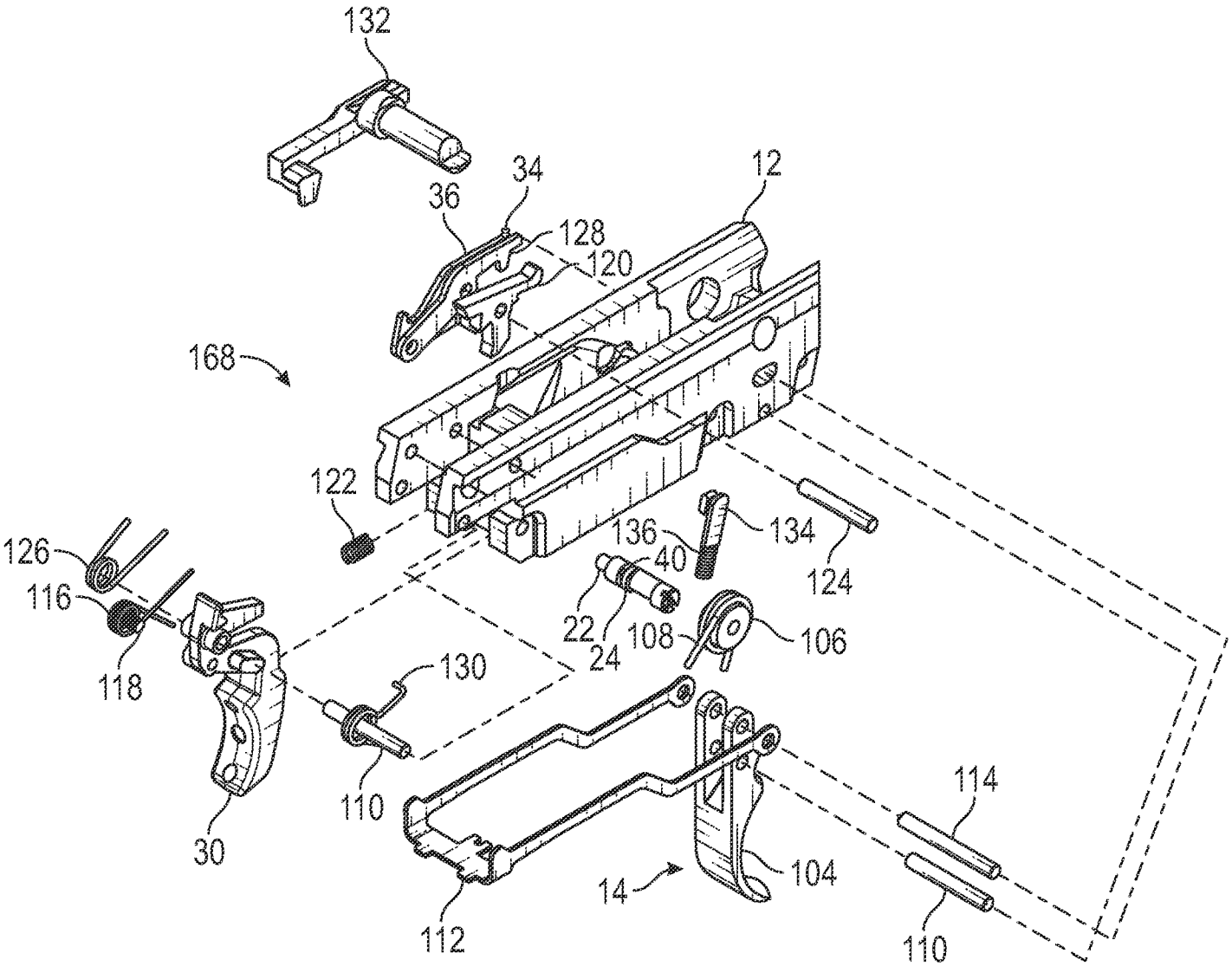
FIG. 3 is an exploded view of the frame assembly of FIG. 1.
Figure 4:
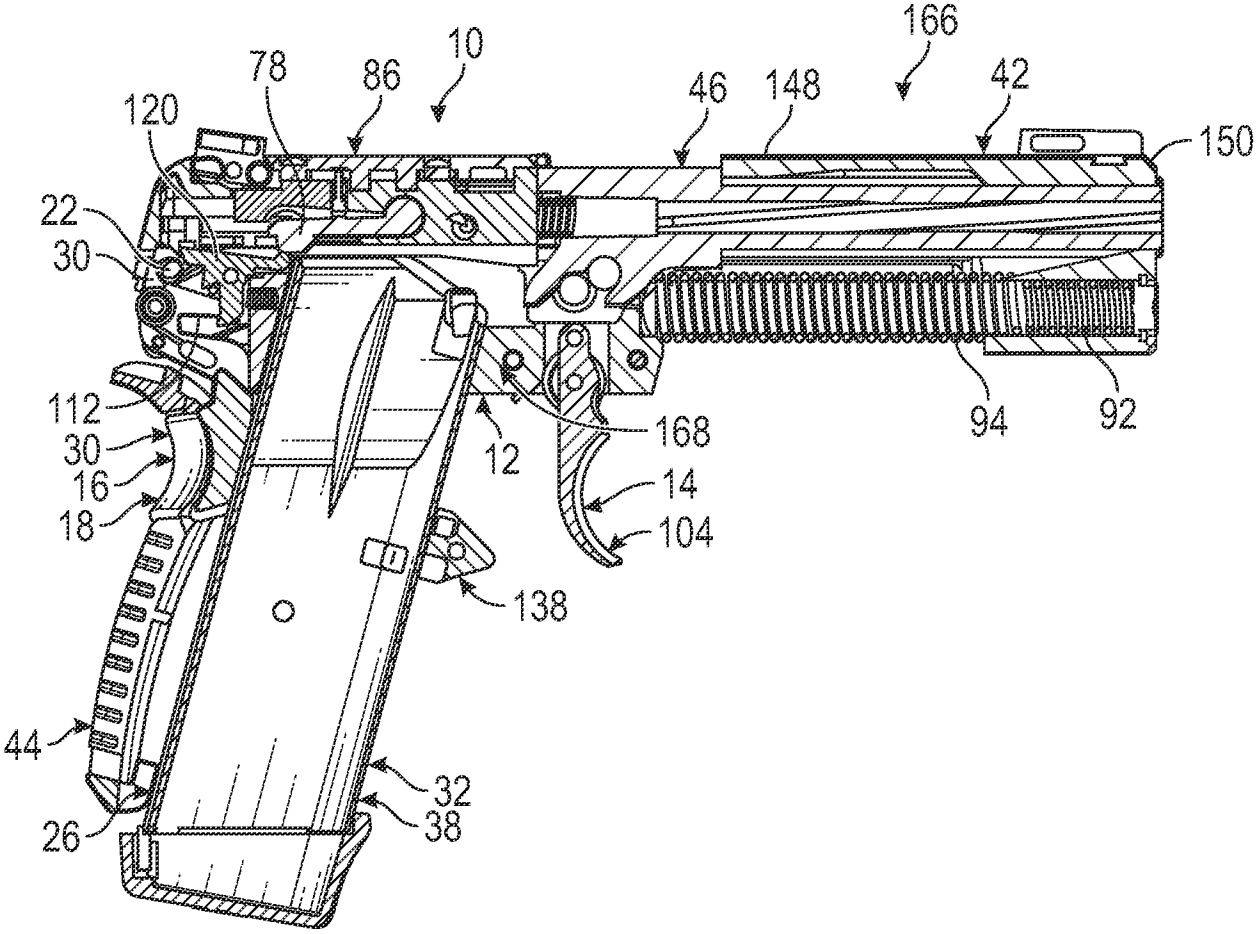
FIG. 4 is a side sectional view of the view of the pistol of FIG. 1.
Figure 5:
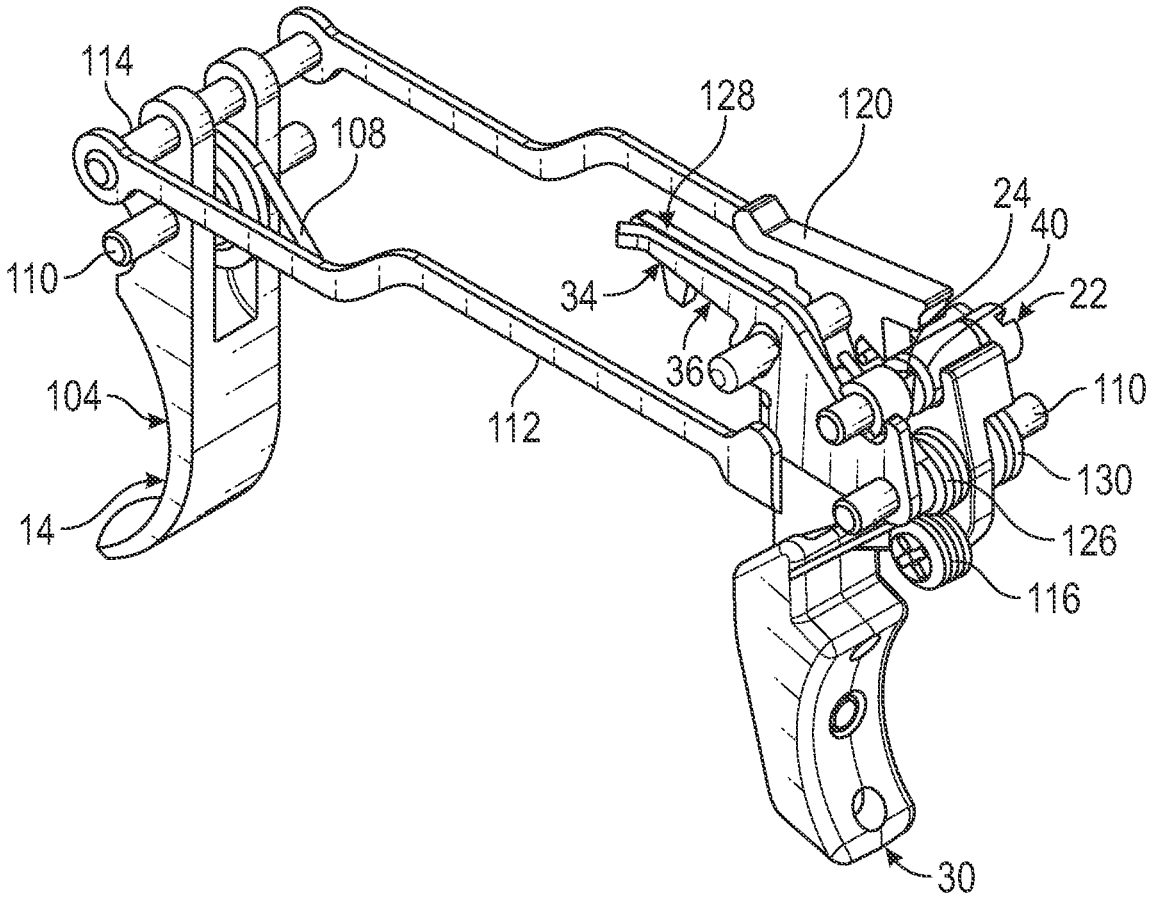
FIG. 5 is a rear isometric view of the firing facility, safety device, actuator, and selector of FIG. 1.

Referring now to FIG. 3-5, the frame assembly 168 of the pistol 10 has a frame 12, trigger 104, trigger bushing 106, trigger spring 108, 3/3 2×11/16 dowel pins 110, trigger bar 112, 3/3 2×13/16 dowel pin 114, trigger bar spring 116, 2-56×3/16 button head screw 118, sear 120, sear spring 122, 3/3 2×⅝ dowel pin 124, magazine safety 34, magazine safety spring 126, ejector 128, grip safety 30, grip safety spring 130, selector 22, slide stop 132, slide stop snap 134, and slide stop snap spring 136. The selector is only accessible with the slide assembly 166 removed from the frame to prevent an inadvertent change of the selector's position. In the current embodiment, the pistol is sold with the selector in the position that enables both the grip safety 30 and the magazine safety 34. The user must deliberately remove the slide assembly from the frame and rotate the selector to change the selector's position to disable either safety should the user desire to enable tactical reloading, or if the user's hand is incapable of disengaging the grip safety. In the current embodiment, the selector is limited to three positions by the geometry of the cam profiles 24, 40 on the selector so that the user cannot disable just the grip safety.

Figure 6:
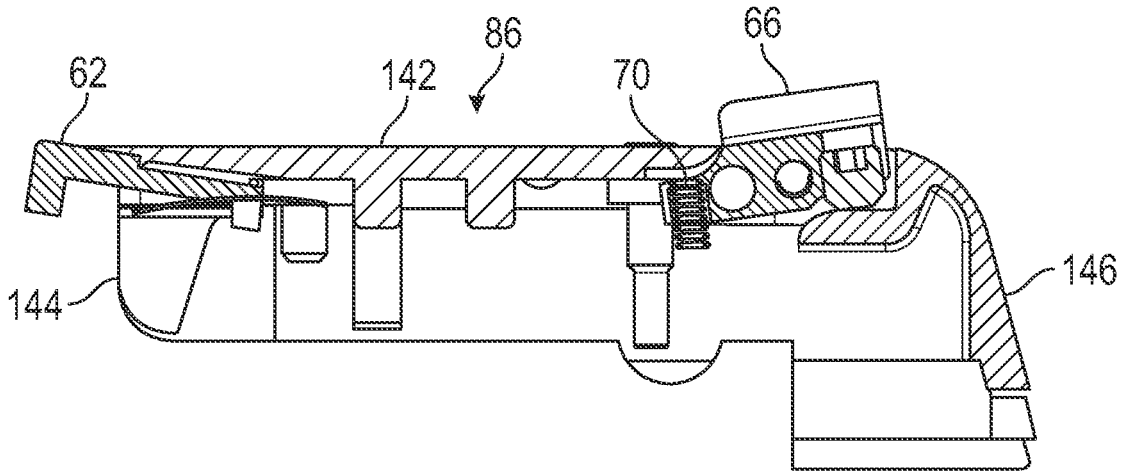
FIG. 6 is a side sectional view of the slide cover of FIG. 1.

FIG. 6 illustrates the improved slide cover 86 of the present invention. More particularly, the slide cover has a top 142, front 144, and rear 146. The rear sight 66 is attached to the top rear of the slide cover, and the chamber indicator 62 is attached to the top front of the slide cover. The chamber indicator indicates if a round is currently chambered within the barrel 46.

Figure 7:
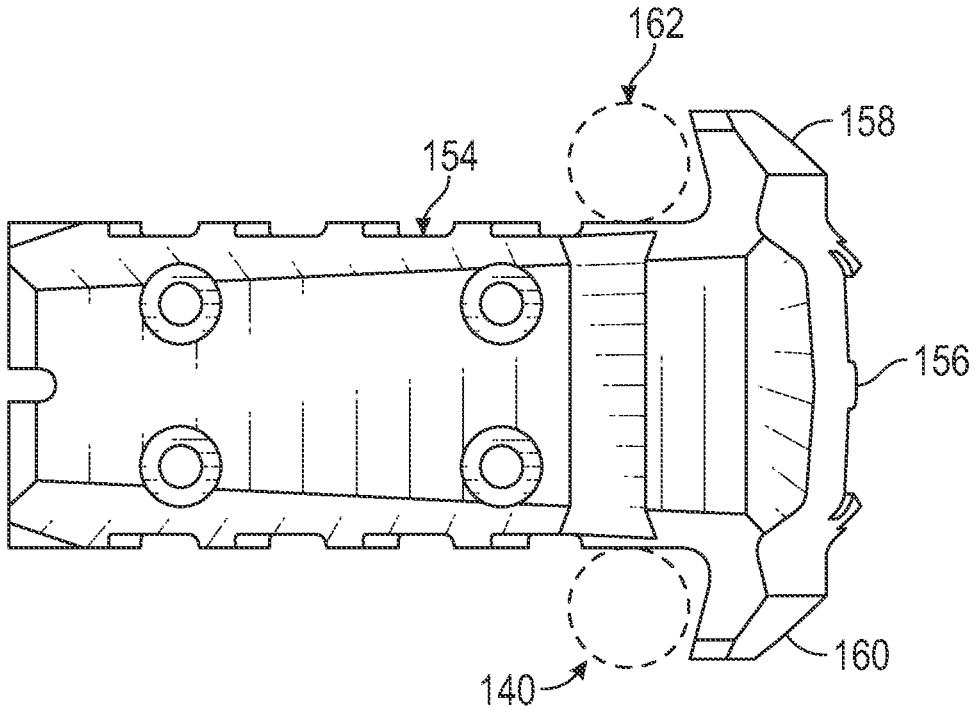
FIG. 7 is a top view of an alternative embodiment of the slide cover of FIG. 1.
Figure 8D:
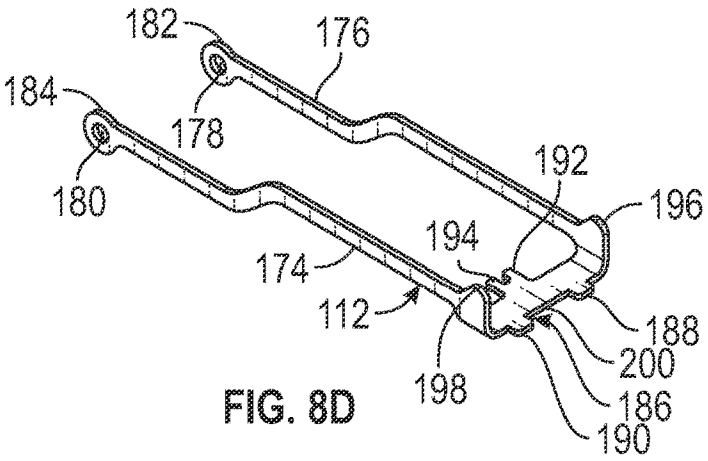
FIG. 8D is a rear isometric view of the trigger bar of FIG. 1 in the bent condition.
Figure 8A:
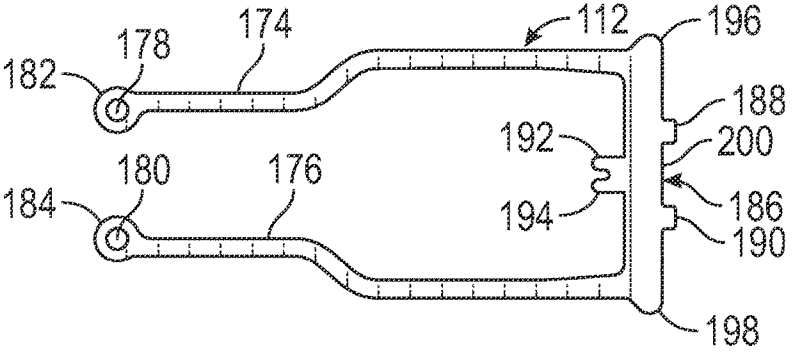
FIG. 8A is a top view of the trigger bar of FIG. 1 in the flat condition.
Figure 8B:
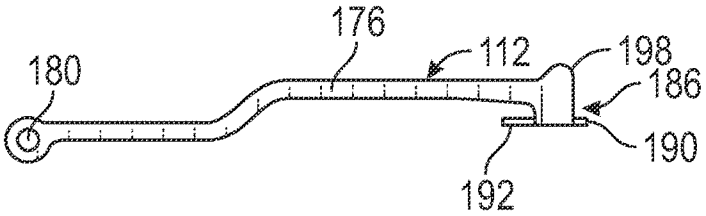
FIG. 8B is a left side view of the trigger bar of FIG. 1 in the bent condition.
Figure 8C:
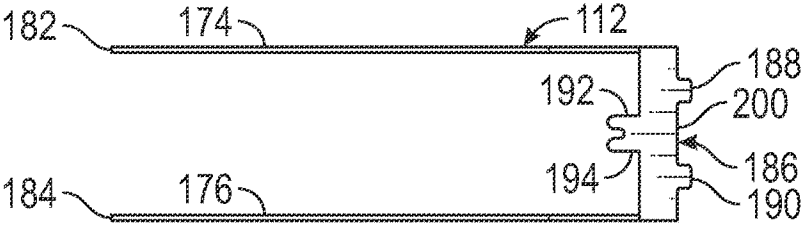
FIG. 8C is a top view of the trigger bar of FIG. 1 in the bent condition.

FIG. 7 illustrates an alternative embodiment of the improved slide cover 154 of the present invention. More particularly, the slide cover 154 can be used as a replacement for the slide cover 86. The slide cover 154 has a rear 156 forming a right wing 158 and a left wing 160. The wings enable a user who is unable to grip the serrated sides 170, 172 of the slide cover 86 with sufficient force to pull the slide assembly 166 rearward to chamber a round to still use the user's forefinger 140 and user's middle finger 162 to pull the slide assembly 166 rearward to chamber a round by engaging the wings. The slide cover 154 is only one example of numerous alternative slide covers that can be provided to enable different capabilities of the pistol 10. Alternative slide covers can include a red dot sight or another style of integrated rear sight. Alternative slide covers can have different types of serrated sides to provide different grip characteristics. Alternative slide covers can also be made in different colors to denote different capabilities of the pistol, user, or ammunition.

FIGS. 8A-D illustrate the improved trigger bar 112 of the present invention. More particularly, the trigger bar has two arms 174, 176, each of which terminates in an aperture 178, 180 at their forward ends 182, 184. The two arms are connected at their rear ends by a rear bar 186. The rear bar has two rearward protrusions 188, 190 and a forward protrusion 192 defining a slot 194. The trigger bar is initially formed as a planar element shown in FIG. 8A that is subsequently bent into the finished condition shown in FIGS. 8B-D. After bending, the rear bar has two upward facing protrusions 196, 198. In the current embodiment, the trigger bar has a maximum length of 65.5 mm and a length of 64.0 mm excluding the length of the rearward protrusions. The apertures have a diameter of 2.38 mm. The trigger bar has a maximum width of 19.5 mm. The slot has a width of 1.2 mm. The gap 200 between the two rearward protrusions has a width of 7.0 mm. The trigger bar has a material thickness of 0.64 mm. The use of two arms instead of the single arm associated with a conventional trigger bar greatly reduces the bending stresses in the contact areas, enabling a thin gauge material to be used. The trigger 104 is centered between the arms so the forces applied to both arms are equally balanced to avoid eccentric loads. The extremely thin gauge of the trigger bar material enables the overall width of the pistol 10 to be narrower than a conventional pistol to improve concealment. The extremely thin gauge of the trigger bar material also reduces the mass of the trigger bar, which enables the trigger to have reduced mass compared to a conventional trigger. The reduced mass of the trigger keeps the center of mass balanced to prevent the pistol from inadvertently firing if dropped. The reduced weight of the pistol compared to a conventional pistol also makes the pistol more attractive for carry.

While a current embodiment of a pistol has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pistol comprising:

a frame;

a firing facility connected to the frame and operable to discharge the pistol;

a safety device connected to the frame and having a safe condition in which discharge is disabled and an operable condition in which discharge is enabled;

an actuator responsive to the presence of a safety-indicating element, and operably connected to the safety device to control the condition of the safety device such that the safety device is in the safe condition when the safety-indicating element is absent and in the operable condition when the safety-indicating element is present;

a selector connected to the frame and operably connected to the safety device;

the selector being movable between an enabled position in which the safety device is operably responsive to the presence and absence of the safety-indicating element, and a disabled position in which the safety device remains in the operable condition irrespective of the presence and absence of the safety-indicating element; and including a removable slide connected to the frame, and operable to reciprocate on the frame, the selector being enclosed and rendered inaccessible for movement except when the slide is removed.

2. The pistol of claim 1 wherein the safety-indicating element is a user's grip hand, and the actuator is a grip safety.

3. The pistol of claim 1 wherein frame defines a magazine well, the safety-indicating element is a magazine, and the actuator is a magazine safety.

4. The pistol of claim 1 including a second safety device associated with a second actuator, and wherein the selector is movable between at least three positions.

5. The pistol of claim 4 wherein at least a first one of the positions operates to disable both safety devices, a second one operates to enable both safety devices, and a third one operates to enable only one of the safety devices.

6. A pistol comprising:

a frame;

a firing facility connected to the frame and operable to discharge the pistol;

a safety device connected to the frame and having a safe condition in which discharge is disabled and an operable condition in which discharge is enabled;

an actuator responsive to the presence of a safety-indicating element, and operably connected to the safety device to control the condition of the safety device such that the safety device is in the safe condition when the safety-indicating element is absent and in the operable condition when the safety-indicating element is present;

a selector connected to the frame and operably connected to the safety device;

the selector being moveable between an enabled position in which the safety device is operably responsive to the presence and absence of the safety-indicating element, and a disabled position in which the safety device remains in the operable condition irrespective of the presence and absence of the safety-indicating element;

including a second safety device associated with a second actuator, and wherein the selector is movable between at least three positions; and wherein at least a first one of the positions operates to disable both safety devices, a second one operates to enable only a first one of the safety devices, and a third one operates to enable only a second one of the safety devices.

7. A pistol comprising:

a frame;

a firing facility connected to the frame and operable to discharge the pistol;

a safety device connected to the frame and having a safe condition in which discharge is disabled and an operable condition in which discharge is enabled;

an actuator responsive to the presence of a safety-indicating element, and operably connected to the safety device to control the condition of the safety device such that the safety device is in the safe condition when the safety-indicating element is absent and in the operable condition when the safety-indicating element is present;

a selector connected to the frame and operably connected to the safety device;

the selector being moveable between an enabled position in which the safety device is operably responsive to the presence and absence of the safety-indicating element, and a disabled position in which the safety device remains in the operable condition irrespective of the presence and absence of the safety-indicating element;

including a second safety device associated with a second actuator, and wherein the selector is movable between at least three positions; and wherein at least a first one of the positions operates to enable both safety devices, a second one operates to enable only a first one of the safety devices, and a third one operates to enable only a second one of the safety devices.

8. The pistol of claim 1 wherein the selector is rotatably received in the frame.

9. The pistol of claim 1 wherein the selector is an elongated shaft having a cam operable to limit the position of the safety device.

10. A pistol comprising:

a frame;

a firing facility connected to the frame and operable to discharge the pistol;

a safety device connected to the frame and having a safe condition in which discharge is disabled and an operable condition in which discharge is enabled;

an actuator responsive to the presence of a safety-indicating element, and operably connected to the safety device to control the condition of the safety device such that the safety device is in the safe condition when the safety-indicating element is absent and in the operable condition when the safety-indicating element is present;

a selector connected to the frame and operably connected to the safety device;

the selector being moveable between an enabled position in which the safety device is operably responsive to the presence and absence of the safety-indicating element, and a disabled position in which the safety device remains in the operable condition irrespective of the presence and absence of the safety-indicating element;

wherein the selector is an elongated shaft having a cam operable to limit the position of the safety device; and including a second safety device associated with a second actuator, and wherein the selector has at least two different cam profiles, each associated with a respective one of the safety devices.

11. A pistol comprising:

a frame;

a firing facility connected to the frame and operable to discharge the pistol;

a first safety device connected to the frame and having a safe condition in which discharge is disabled and an operable condition in which discharge is enabled;

a first actuator responsive to the presence of a first safety-indicating element, and operably connected to the safety device to control the condition of the safety device such that the first safety device is in the safe condition when the first safety-indicating element is absent and in the operable condition when the safety-indicating element is present;

a second safety device connected to the frame and having a safe condition in which discharge is disabled and an operable condition in which discharge is enabled;

a second actuator responsive to the presence of a second safety-indicating element, and operably connected to the safety device to control the condition of the safety device such that the second safety device is in the safe condition when the first safety-indicating element is absent and in the operable condition when the safety-indicating element is present;

a selector connected to the frame and having a first selector portion operably connected to the first safety device and having a second selector portion operably connected to the second safety device; and the selector being movable between a first selector position in which the first safety device is enabled and the second safety device is disabled, and a second selector position in which the second safety device is enabled and the first safety device is disabled.

12. The pistol of claim 11 wherein the selector is movable to a third position in which both the first safety device and second safety device are enabled.

13. The pistol of claim 11 wherein the selector is movable to a third position in which both the first safety device and second safety device are disabled.

14. The pistol of claim 13 wherein the selector is movable to a fourth position in which both the first safety device and second safety device are enabled.

15. The pistol of claim 11 wherein the first selector portion and the second selector portion are spaced apart from each other.

16. The pistol of claim 11 wherein the first safety device and second safety device are each operable independent of the other, such that the condition of one safety device does not affect the condition of the other safety device.

* * * * *